US006684867B2

(12) United States Patent
Ito et al.

(10) Patent No.: US 6,684,867 B2
(45) Date of Patent: Feb. 3, 2004

(54) IGNITION APPARATUS FOR INTERNAL COMBUSTION ENGINE AND ONE-CHIP SEMICONDUCTOR FOR INTERNAL COMBUSTION ENGINE IGNITING

(75) Inventors: Takashi Ito, Naka-machi (JP); Katsuaki Fukatsu, Urizura-machi (JP); Ryoichi Kobayashi, Tokai-mura (JP); Noboru Sugiura, Mito (JP)

(73) Assignees: Hitachi, Ltd., Tokyo (JP); Hitachi Car Engineering Co., Ibaraki (JP)

( * ) Notice: Subject to any disclaimer, the term of this patent is extended or adjusted under 35 U.S.C. 154(b) by 0 days.

(21) Appl. No.: 09/796,717

(22) Filed: Mar. 2, 2001

(65) Prior Publication Data

US 2001/0037801 A1 Nov. 8, 2001

(30) Foreign Application Priority Data

Mar. 3, 2000 (JP) ..... 2000-063279

(51) Int. Cl.[7] ..... F02P 11/00
(52) U.S. Cl. ..... 123/644; 123/650; 123/630
(58) Field of Search ..... 123/630, 644, 123/650, 406.12, 406.13, 634, 636; 701/100, 114, 101, 102, 110; 324/380, 382

(56) References Cited

U.S. PATENT DOCUMENTS 4,088,107 A * 5/1978 Chateau ..... 123/651
4,522,185 A * 6/1985 Nguyen ..... 123/637
5,373,826 A * 12/1994 Taruya et al. ..... 123/634
5,636,097 A * 6/1997 Palara et al. ..... 361/101
5,970,964 A * 10/1999 Furahata et al. ..... 123/644
6,378,514 B1 * 4/2002 Kaminaga et al. ..... 123/633

FOREIGN PATENT DOCUMENTS

JP 53-118781 10/1978
JP 8-335522 12/1996

* cited by examiner

*Primary Examiner*—Hieu T. Vo
*Assistant Examiner*—Johnny H. Hoang

(57) ABSTRACT

An ignition apparatus for an internal combustion engine has an arrangement comprising a power part and a control part which are accumulated in a one-chip in an IGBT monolithic silicon substrate. The control circuit part has current limiting function of prevent the flowing of any current which is above a predetermined value as well as function of detecting malfunction heat generation by which a primary electric current is blocked compulsorily. The secondary voltage of an ignition coil is generated repeatedly below a plug discharge voltage so as not to generate spark discharge in the sparking plug when the electric current compulsory blocking is carried out, and energy charged in the ignition coil is emitted or discharged. With this arrangement, the one-chip ignition apparatus with high reliability can be achieved.

8 Claims, 8 Drawing Sheets

2a:106.7kpa(NORMAL PRESSURE )

2b:40kpa

2c:20kpa

2d:13kpa

20e:13kpa

IGNITION APPARATUS FOR INTERNAL COMBUSTION ENGINE AND ONE-CHIP SEMICONDUCTOR FOR INTERNAL COMBUSTION ENGINE IGNITING

BACKGROUND OF THE INVENTION

The present invention relates to an ignition apparatus for an internal combustion engine and a one-chip semiconductor for this.

There is an ignition apparatus for an internal combustion engine described in Japanese Patent Application Laid-Open No. Hei 8-335522 as one prior art, in which a power switching part, a current limiting circuit acting as a protection circuit and a thermal shut-off circuit which compulsorily intercepts or blocks current flowing at the time of abnormal heat generation are integrated all together on an IGBT monolithic silicon substrate. Moreover, a suppression method is devised by setting up a collector clamping voltage to be tens of voltages, as a method of not generating high voltage at the secondary side of an ignition coil, at the time when compulsion turn the current off by the voltage generation of as many as the turn ratio times. There is an ignition apparatus for an internal combustion engine described in Japanese Patent Application Laid-Open No. Sho 53-118781 as another prior art. In this ignition apparatus, a hybrid IC equipped with electronic parts on a ceramic substrate etc. is used. This ignition apparatus has its function for dully intercepting the primary electric current due to the Miller integration effect using a capacitor by detecting the malfunction of the ignition signal.

The prior art as shown in Japanese Patent Application Laid-Open No. Hei 8-335522 has installed a current limit circuit and a thermal shut-off circuit in the igniter apparatus as security or protection function. However, when an element temperature becomes more than a set temperature, such a simple thermal shut-off circuit compulsorily makes the gate signal of the power transistor LOW, is generated high voltage by this operation at the ignition coil secondary side because it is the function to intercept the primary current which flows in the ignition coil quickly, and generates electrical discharge in the sparking plug. Therefore, there is a possibility to cause deleterious combustion like backfire, etc. according to the process of the engine. It is necessary not to generate a high voltage at the secondary side of the ignition coil to prevent this deleterious combustion at the compulsion turn the current off. A suppression method is devised by dropping the collector clamping voltage to tens of V as a simplest prevention method by the voltage generation of as many as the turn ratio times. However, it is usually undesirable to be necessary to operate by 24V+$\alpha$ of the battery series connection, and to adjust the collector clamping voltage to 30V or less as the ignition apparatus for cars. In case where the coil turn ratio of the ignition coil is 100 and the collector clamp voltage is 30V, for example, if the Vce voltage during the current limit is thought to be 7V, because the voltage of which value is turn ratio times of the collector voltage is generated at the secondary side of the ignition coil, the high voltage of 2.3 kV which is 100 times of 30V−7V=23V is generated. Spark discharge voltage generated at a spark plug differs depending upon the operating condition of the engine, and in case where pressure is high and air density thick, the spark discharge voltage is high, and conversely, in case where pressure is low and air density is thin, the discharge voltage is low. That is, because pressure goes up in the state to take a lot of air in the compression process of the engine, a high secondary voltage is demanded, and because negative pressure occurs in the state that air flow rate is small during the engine air suction process, spark discharge is generated at a low secondary voltage. High negative pressure is generated in case where the engine is operated at high speed and a throttle valve is closed rapidly when piston speed is high. This general value is Absolute Pressure 13–14 kPa (atmospheric pressure: 106.7 kPa). In case where the primary current is compulsorily blocked, since it is necessary for spark discharge not to be generated in any condition of the engine, so it is needed to suppress the secondary voltage to above such a value that spark discharge does not occur, even though the spark discharge can be easily generated by negative pressure. Especially, since when the engine shows negative pressure is in its suction process, igniting under such a condition causes the deleterious combustion of the engine such as backfire, etc. The one that the relation between negative pressure and spark discharge was found by the experiment is shown in FIG. 1. In this experiment, Sparking Plug F7LTCR made by BOSCH (GAP width: 1.2 mm) mounted in an aluminum chamber of which internal pressure is decreased by a outside negative pressure pump was used, and its pressure and the secondary voltage at which spark discharge generates at at that time were measured. 1*a*, 1*b*, 1*c* and 1*d* show discharge voltage waveforms at the time of the atmospheric pressure (106.7 kPa), 40 kPa, 20 kPa and 13 kPa, respectively. As is clear from the results of this experiment, the plug discharge voltage at the time of the absolute pressure of 13 kPa is 1.5 kV, so in order not to generate the spark discharge at the sparking plug it is needed to suppress the secondary voltage to under about 1 kV. Waveform 1*e* shows the fact that discharge does not occur at 1 kV even at the time of the absolute pressure 1.3 kV. This means that with the system in which said collector clump voltage is made to 330V, the plug discharge cannot be avoided.

Moreover, with the technology which prevents electrical discharge at the sparking plug by dully intercepting the primary electric current using the Miller integration effect with the capacitor and controlling a high voltage generated at the secondary side of the ignition coil, as shown in the above-mentioned Japanese Patent Application Laid-Open No. Sho 53-118781, to intercept the primary electric current dully to prevent the electrical discharge at the sparking plug, a capacitor with large capacity is needed. Therefore, making it on a silicon substrate is extremely disadvantageous in the size.

SUMMARY OF THE INVENTION

In order to settle the problems of the above-mentioned prior techniques, in accordance with this invention, when the collector current of a power transistor is blocked compulsorily at the time of abnormal heat generation, the collector current is changed so that the secondary voltage becomes under the plug discharge voltage in order not to generate spark discharge due to the secondary voltage generated at the secondary side of the ignition coil, said secondary voltage is generated repeatedly by repeating this control, and energy is emitted which has been charged in the ignition coil. Experiment waveforms on the desk of the circuit which achieves the present invention is shown in FIG. 2. It is understood from the waveforms to be able to obstruct deleterious ignition by no generating the plug electrical discharge because the generated secondary voltage is discharged repeatedly by 800V peak. Through the control of the gate voltage like this and the control of the amount of change of the primary electric current, it is possible to intercept compulsorily the primary electric current while controlling the voltage generated at the secondary side of the ignition coil to become 1 kV or less.

As means for generating repeating the secondary voltage below this plug discharge voltage, a digital control circuit which changes the collector electric current in a step way by using a pulse waveform is used. As a result, it is possible to form the control circuit easily on a silicon substrate without needing a capacitor with large capacity. Moreover, after compulsory interception is performed once, a latch circuit which does not carry out current flowing until the ignition control signal becomes LOW again is installed. As a result, abnormal current flowing operation is prevented by the control which does not provide the current flowing again, even if chip temperature becomes below a set value while generating the malfunction current flow. These control circuit components are integrated in the monolithic substrate of the power transistor.

As mentioned above, flying sparks to the sparking plug can be obstructed by controlling the gate voltage of the power transistor to intercept the electric current in a step way so that the secondary voltage generated at the secondary side of the ignition coil is suppressed below the plug discharge voltage when the ignition apparatus generates abnormal heat and intercepts the primary current compulsorily. By integrating these control circuits and power part on the monolithic silicon substrate of the power transistor, it is possible to provide a one-chip ignition apparatus of multi-function with high stability and reliability of operation.

DETAILED DESCRIPTION OF THE PREFERRED EMBODIMENTS

Figure 1:
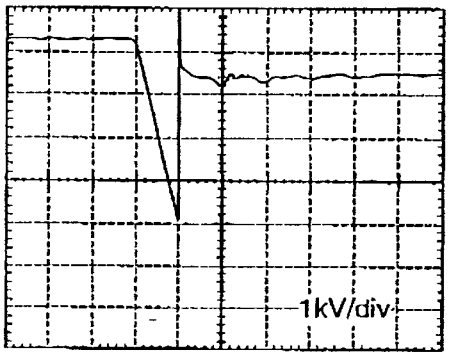
FIG. 1 is waveforms by which the relation between negative pressure and spark discharge voltage is shown.
Figure 1:
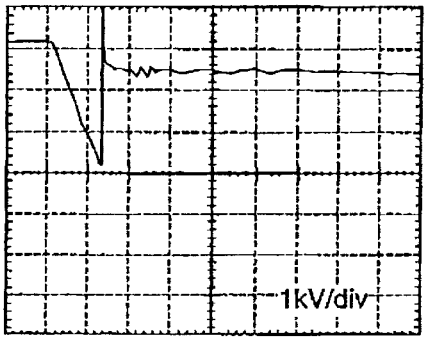
Figure 1:
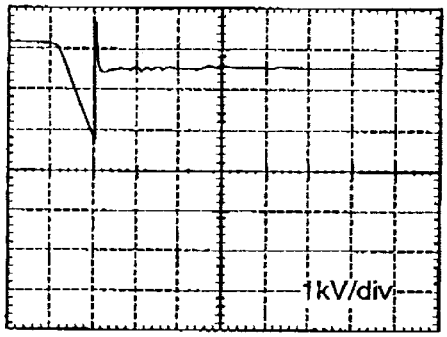
Figure 1:
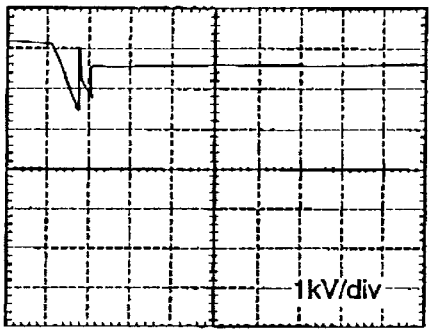
Figure 1:
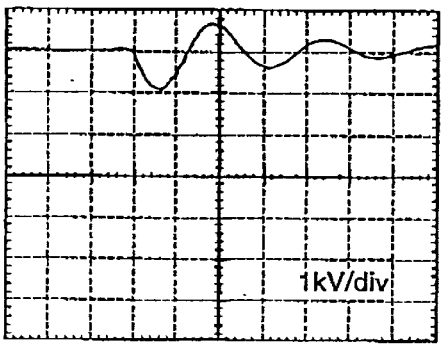
Figure 2:
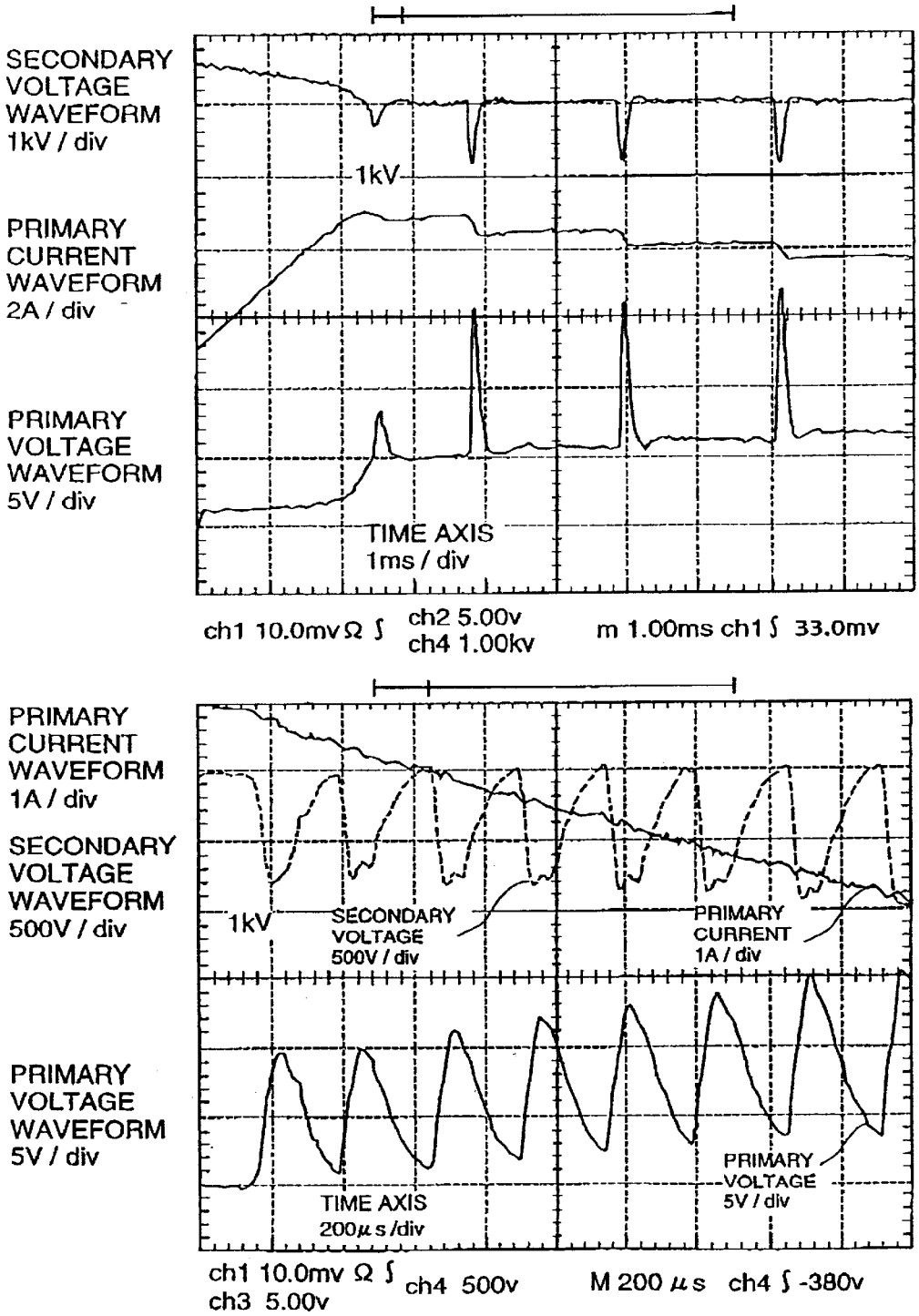
FIG. 2 is experiment waveforms prepared on the desk of the present invention.
Figure 3:
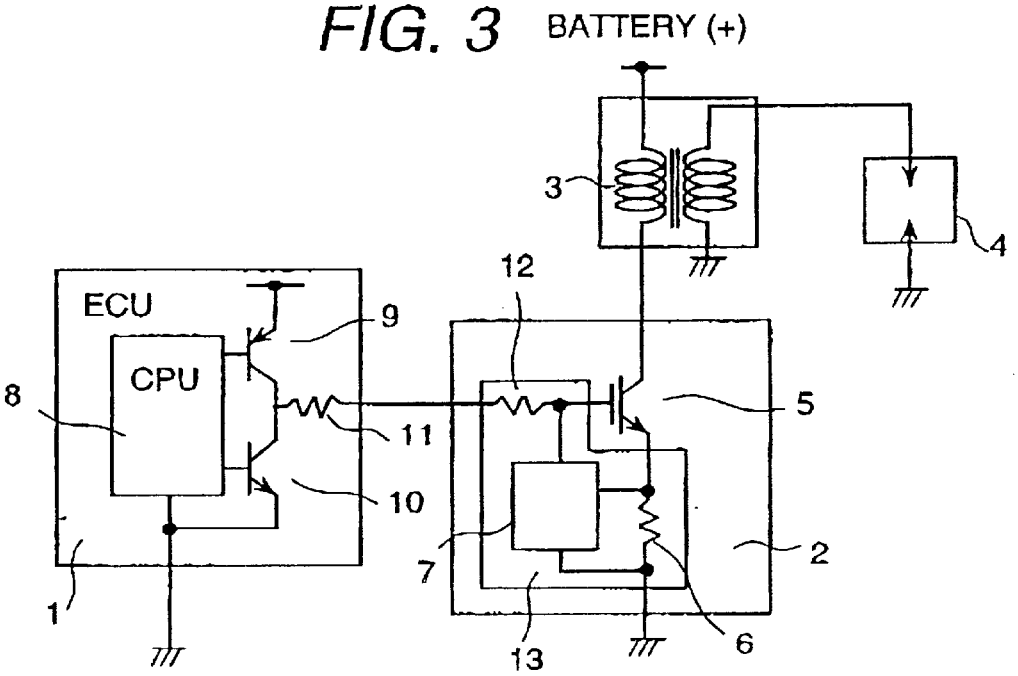
FIG. 3 is an arrangement of a usual ignition apparatus.
Figure 4:
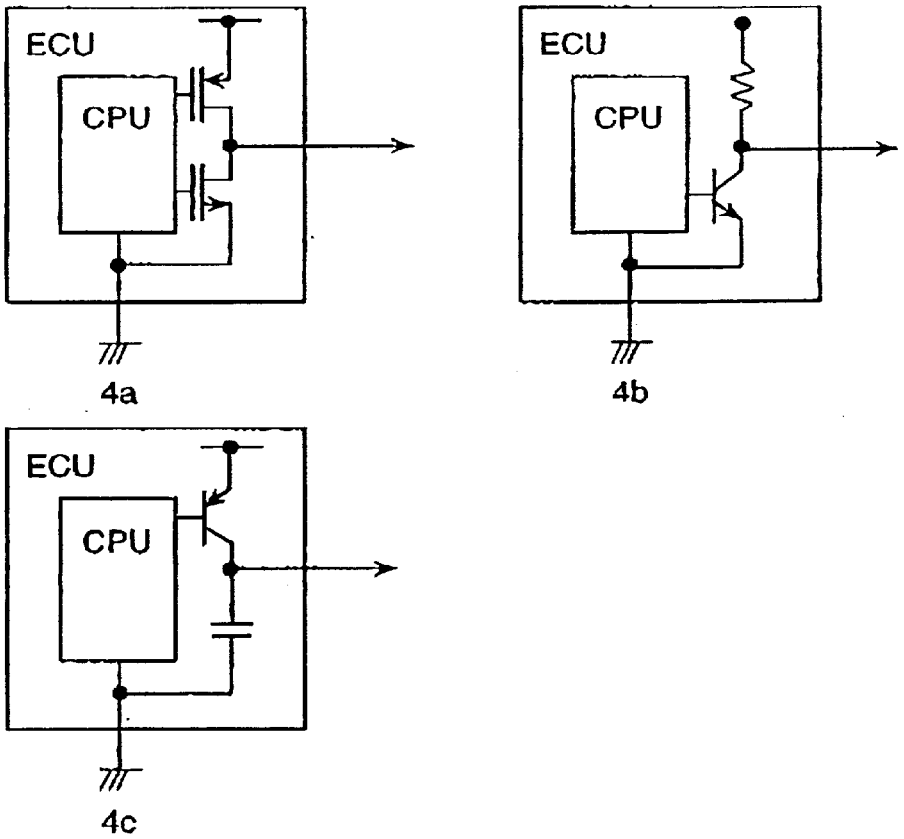
FIG. 4 is an example of a typical driving circuit.

The example of composing a usual ignition system is shown in FIG. 3. Reference numeral 1 shows an ECU, 2 shows an ignition apparatus, 3 shows an ignition coil, and 4 shows a sparking plug. The output stage of the ECU 1 is composed of a resistor 11, a PNP transistor 9 and an NPN transistor 10. An transistors 9 and 10 are turned on or off according to proper ignition timing calculated by CPU 8, and the pulse of HIGH and LOW is output to the ignition apparatus 2. The ignition apparatus 2 comprises a power transistor 5, and a current detecting resistor 6, a current controlling circuit 7 and an input resistor 12 mounted on a hybrid IC 13. High voltage which corresponds to the coil winding number ratio between the primary and secondary windings of the ignition coil is generated at the secondary side of the ignition coil by generating a voltage on the collector of the power transistor 5 by beginning the conduction of the transistor with LOW→HIGH of the output signal of ECU 1 and intercepting or blocking its current flowing with HIGH→LOW, and it generates spark discharge between the electrodes of the sparking plug and burns the mixture. Additionally, a typical driving circuit is shown in FIG. 4. Reference numeral 4*a* shows PMOS and NMOS transistors tied to make up a complementary combination, and 4*b* is the one having composed of a pull-up resistor and an NPN transistor. Moreover, 4*c* is a method to flow an electric current with a PNP transistor. Although, they are different from each other in their circuit systems, each circuit outputs an electric current and voltage necessary to drive the igniter to charge energy in the ignition coil at timing to generate spark discharge in the sparking plug at the optimum ignition time obtained by ECU.

Figure 5:
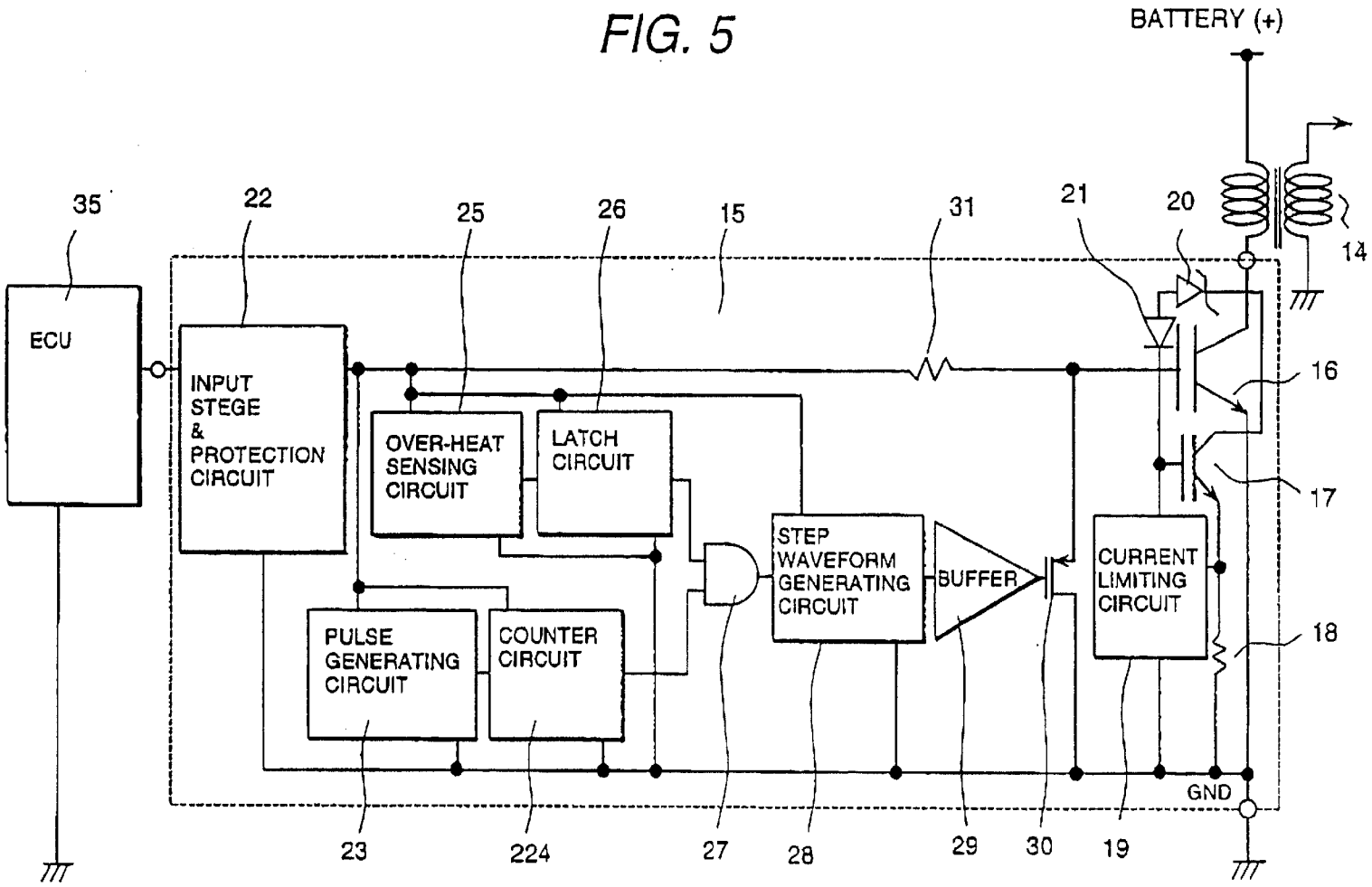
FIG. 5 is a block diagram which shows an embodiment of the present invention.

The block diagram of an ignition apparatus which is one embodiment of the present invention is shown in FIG. 5. Reference numeral 14 is an ignition coil, 15 is an ignition apparatus according to this inventions 16 is a main IGBT making up the main circuit for flowing and blocking the primary current through the primary coil of the ignition coil, and 17 is a sense IGBT making up a shunt circuit for detecting the current through the IGBT 16. A resistor 18 is connected to the emitter 17 of the IGBT 17, which acts as a current detecting element. It is also connected to a current limiting circuit 19. The input stage of the ignition apparatus connected to an ECU 35 has a protection circuit 22. A control circuit comprises a pulse generating circuit 23, a counter circuit 24, an over-heat sensing circuit 25, a latch circuit 26, an AND logic gate 27, a step waveform generating circuit 28, a buffer 29, a MOS transistor 30 and a resistor 31. The level of the ignition controlling signal from the circuit 22 is applied as an operative voltage to the circuits 23, 24, 25, 26 and 28.

Figure 6:
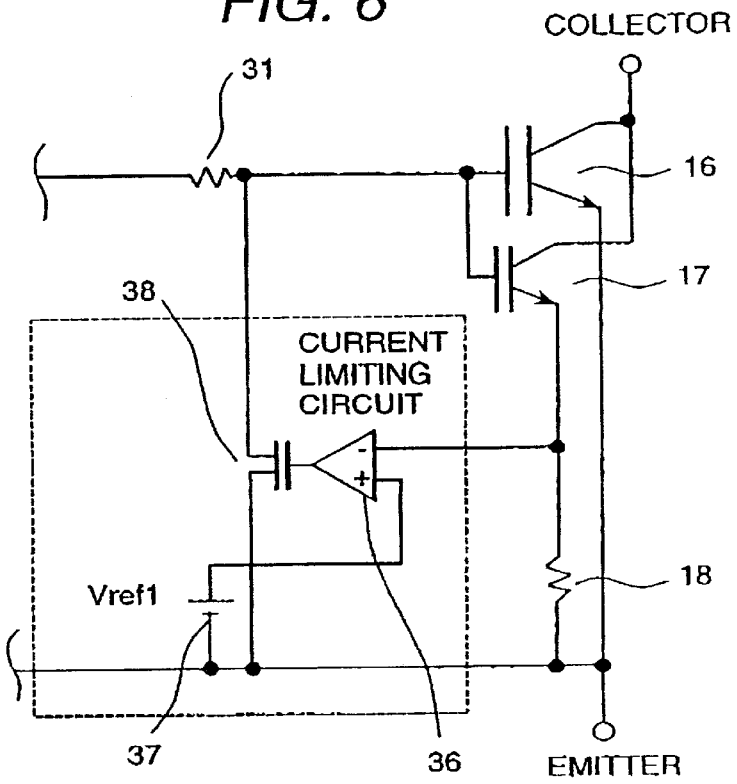
FIG. 6 is one example of a current limiting circuit.

One example of the current limiting circuit 19 is shown in FIG. 6. This circuit compares the voltage generated on the current detecting resistor 18 by a differential amplifier circuit 36 with Vref1 voltage 37 When the voltage of the current detecting resistor 18 becomes the Vref1 voltage 37 or more, the differential amplification circuit 36 outputs Hi output which turns on the transistor 38 and makes the voltage of the gate of the IGBT 16 descend, and thereby limits the current by making the IGBT no-saturation state. In this circuit, by decreasing the Vref1 voltage in a step way, the secondary voltage generated at the secondary side of the ignition coil is repeatedly blocked with the plug discharge voltage and whereby energy which has been charged in the ignition coil is emitted.

Figure 7:
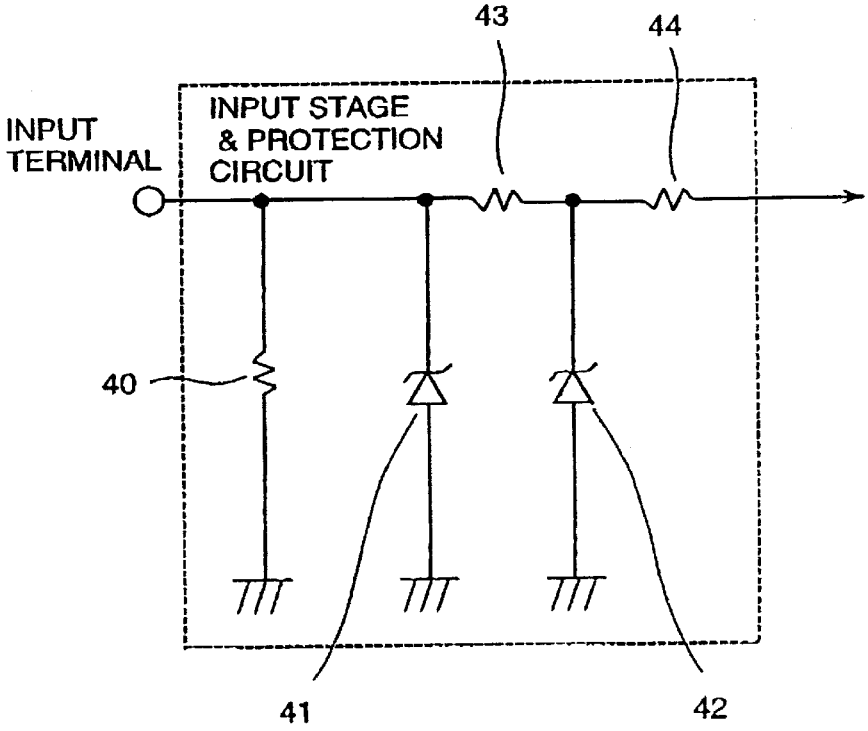
FIG. 7 is an arrangement of an input stage & protection network.

An arrangement of the input stage & protection circuit is shown in FIG. 7. A resistor 40 is a pull-down resistor which acts to secure the contact electric current of the input terminal is secured by pouring a certain electric current with a constant value into the circuit. In addition, by composing a network which consists of breakdown or Zener diodes 41 and 42, and a resistor 43 and 44, an amount that various surges assumed for the car are endured is secured.

Figure 8:
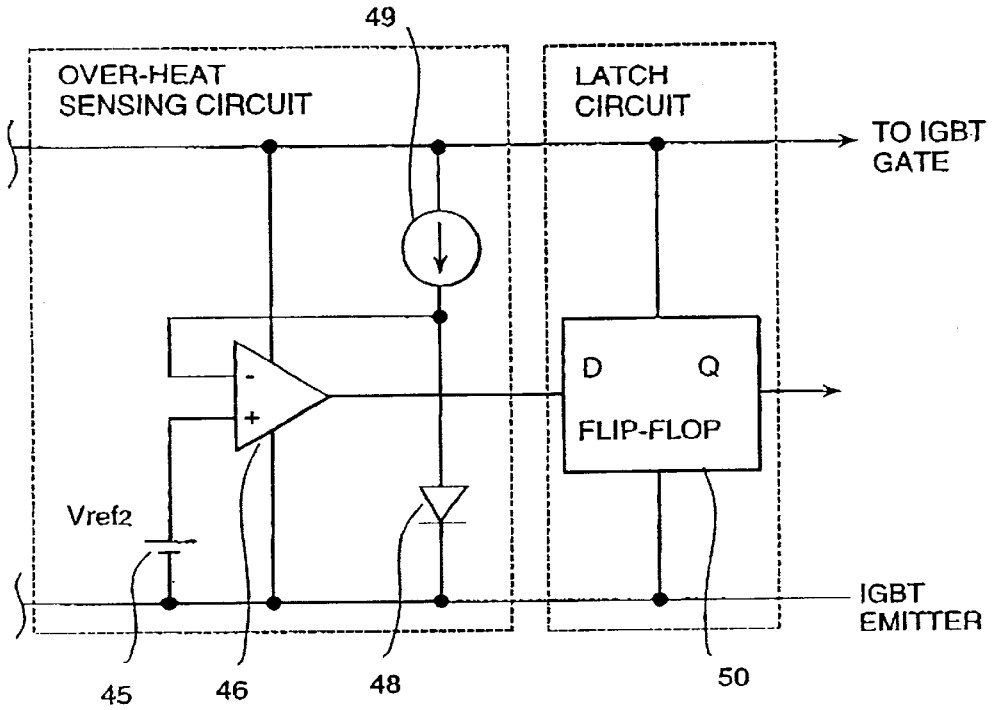
FIG. 8 is one example of an over-heat detecting circuit and latch circuit.
Figure 9:
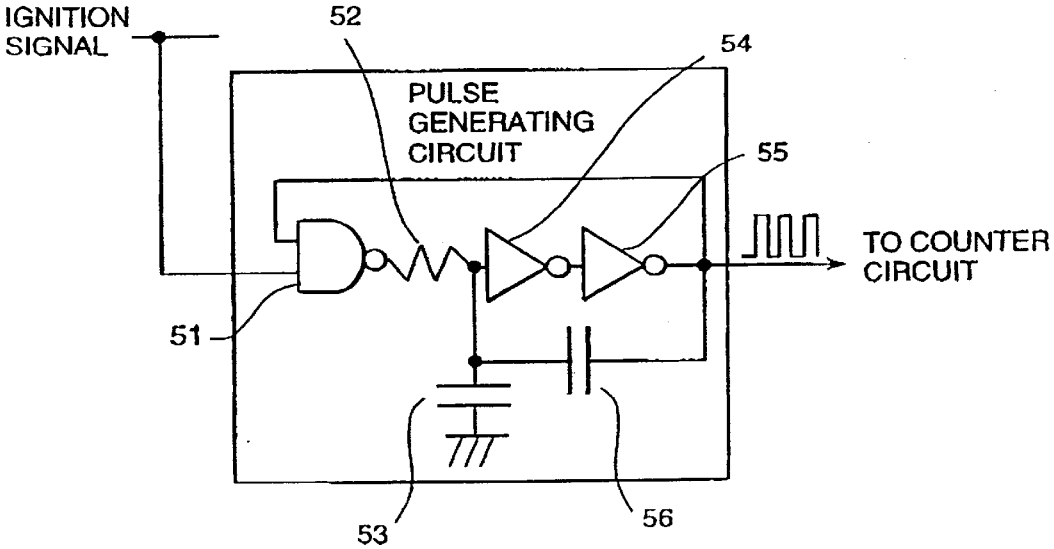
FIG. 9 is one example of a pulse generating circuit.
Figure 10:
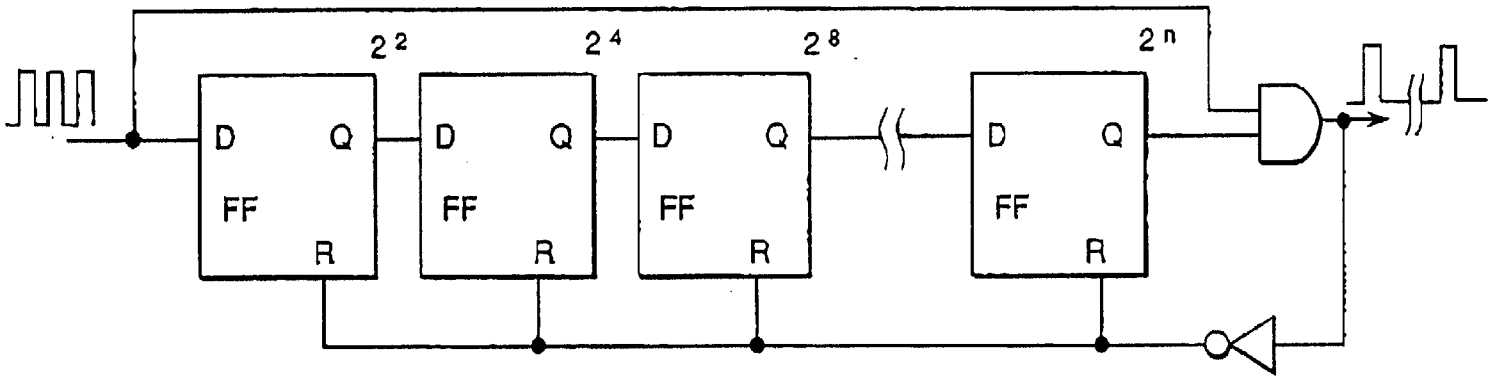
FIG. 10 is one example of a counter circuit.

One example of the over-heat detecting circuit is shown in FIG. 8. This circuit uses the temperature coefficient of the forward voltage of a diode. The diode 48 receives a constant current from a constant current circuit 49 and generates a forward voltage, which is compared in a differential amplification circuit 45 with the Vref2 voltage. The forward voltage of the diode has the negative temperature coefficient of about 2 mV/° C. Therefore, malfunction or abnormal over-heating can be judged by comparing the forward voltage of the diode with the set voltage Vref2 in the differential amplification circuit. Moreover, a method of providing the same function can be devised by using the temperature characteristic of the operating voltage Vth of a MOS transistor. The latch circuit can operate the latch function with a D-type flip-flop 50 as shown in FIG. 8. FIG. 9 shows one example of the pulse generation circuit. This circuit is a free-run pulse generating circuit, in which the output of NAND gate 51 is input to an inverter 54 after it has been integrated by a resistor 52 and a capacitor 53, and further feed-backed through an inverter 55 into the input of the NAND gate 51. As a result, self-oscillation is carried out. A capacitor 56 differentiates the output of the inverter 55 and the resulting waveform is applied to the integration circuit comprising the resistor 52 and the capacitor 53, so that a large amplitude integrated waveform can be provided. A timer circuit is possible with a $2^n$ divisional circuit by using flip-flops like FIG. 10. The input of the first stage and the output of the final stage are ANDed, and, as a result, one pulse shape is output at a certain cycle by giving reset to the flip-flops.

Figure 12:
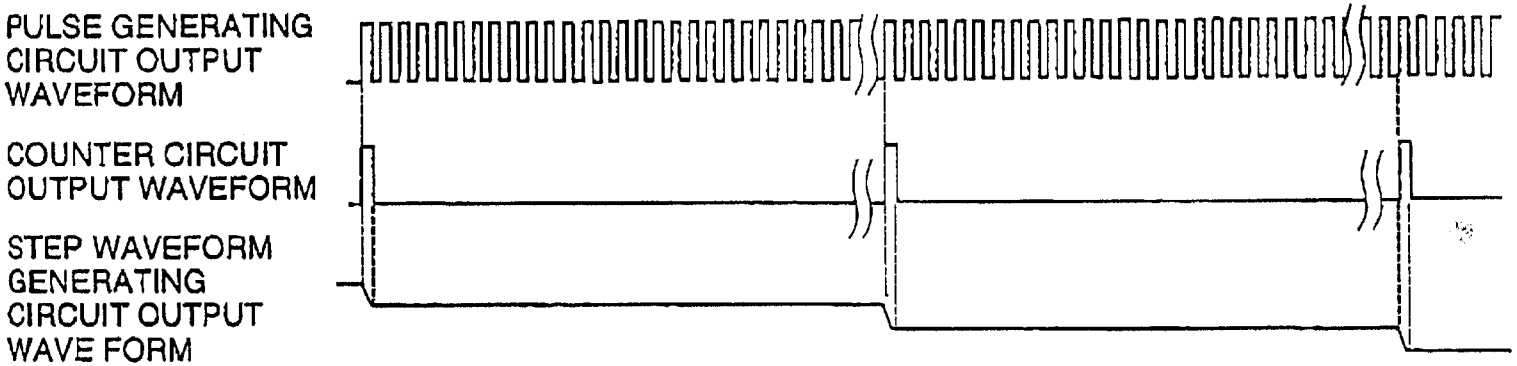
FIG. 12 is a pulse waveform, a counter waveform and a step waveform.
Figure 11:
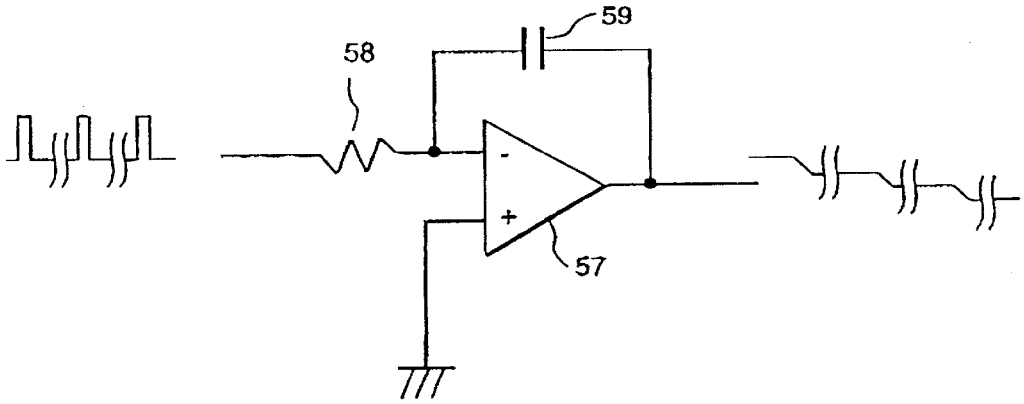
FIG. 11 is one example of a step waveform generating circuit.

FIG. 11 is one example of the step waveform generating circuit, and it uses an application form of integration operation using an OP amplifier 57, and an input resistor 58 and a capacitor 59. The signal output from the counter circuit is input to the inverting terminal of the OP amplifier 57 through the resistor 58. The electric current of I=signal Voltage/Resistance flows virtually because non-inverting terminal of the OP amplifier 57 is the GND level, and the voltage change shown by the expression of V=(1×T)/C in proportion to this occurs in the output of the OP amplifier 57. As a result, it is possible to change the voltage in a step way at each applied pulse. The relation between the pulse generating counter waveform and the step waveform is shown in FIG. 12.

Figure 13:
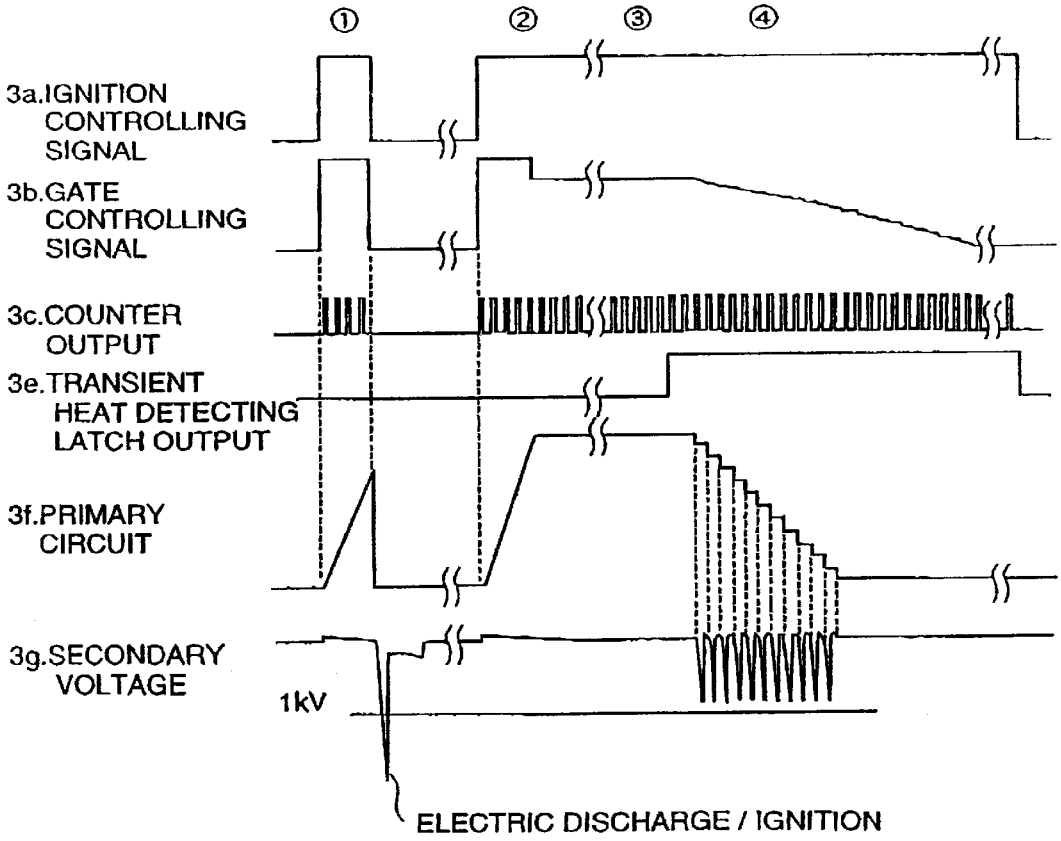
FIG. 13 is operative sequence by which an embodiment of the present invention is shown.

The operation of each circuit is explained by the operation waveforms of FIG. 13. Sequence ① in FIG. 14, the gate control voltage 3*b* is impressed to the main IGBT by the ignition control signal 3*a* output from the ECU 35, and the primary electric current 3*f* flows. The secondary voltage 3*g* is generated at the secondary side of the ignition coil due to a rapid change in magnetic flux at the time when this electric current is intercepted or blocked. When the ignition controlling signal is in Hi, the pulse generating circuit acts as a free-run oscillation circuit which always generates the pulse. This reference pulse is input to the counter circuit 24, and, then, divided. As a result, one pulse will be output for a predetermined period of time as shown in FIG. 12. In Sequence ② in FIG. 13, the ignition controlling signal 3*a* becomes Hi, the gate control voltage 3*b* is turned on, and the primary electric current 3*f* flows. When the primary electric current becomes a set value, the current limiting circuit operates, and the gate controlling voltage is made to descend. As a result, the main IGBT is made in no-saturated condition, and the primary electric current 3*g* is maintained as the value is. In Sequence ③ in FIG. 14, when in the case of the ignition controlling signal being in Hi as it is, the primary electric current 3*g* keeps being flowed at the current limiting value of its value, the heat generation of the IGBT element grows. When the operating temperature of the over-heat detecting circuit 25 is exceeded, a signal is output from the over-heat detecting circuit 25. The latch circuit 26 outputs the Hi output in response to the output of the over-heat detecting circuit 25. When the signal is output once, this latch circuit 26 keeps outputting Hi as long as the ignition control signal 3*a* does not become LOW even if the output signal of the over-heat detecting circuit 25 becomes OFF. The logical product is taken by the AND logical circuit 27 as for the latch output 3*e* and the counter output 3*c*, and the resultant output is input to the step waveform generating circuit 28. Said step-like waveform drives the gate of the transistor 30 through the buffer 29 so that the gate voltage of the main IGBT is decreased in a step way. In Sequence ④ in FIG. 13, the primary electric current 3*f* decreases in a step way while being kept the main IGBT 16 active by decreasing the gate control voltage 3*b* step-wise. Therefore, the changed portion of the gate control voltage 3*b* is set so that the generated secondary voltage may become 1 kV or less. The secondary voltage V2 generated by the change in this primary electric current becomes the value defined by V2=a×L1×(di/dt), in which L1 is the primary inductance of the ignition coil, a is the turn ratio and di/dt is the change portion of the primary electric current. Such control of the gate voltage for controlling the amount of change of the primary current enables to control the voltage generated at the secondary side of the ignition coil to 1 kV or less. For example, an amount of change of the primary current is selected to be less than 0.5A and the period of time during which the current is held can be selected to be above 100 $\mu$s, with step-wise repetition to block the primary current. By repeating this control the primary electric current gradually decreases, finally becomes zero and the compulsory blocking is completed. Thereafter, the primary current continues the zero condition until the ignition control signal becomes LOW.

In accordance with this invention, by compulsorily blocking the primary current in case where abnormal heat generation occurs, it is possible to avoid damage of elements, and by decreasing the current in a step way so as not to generate spark discharge at the ignition plug when the primary current is compulsorily blocked. it is possible to block the current safely, and further by integrating this circuit on a monolithic substrate for the power transistor, it is possible to provide a one-chip igniter with high reliability.

What is claimed is:

1. A one-chip type ignition apparatus for an internal combustion engine, comprising a power switching part configured to carry out current flowing and blocking control for primary current flowing through an ignition coil in response to an ignition control signal outputted from an electronic control device for the internal combustion engine and thereby to generate a high voltage at a secondary side of the ignition coil, and an element protection circuit part integrated on a monolithic silicon substrate of a power transistor together with said power switching part, wherein said ignition apparatus has current limiting function and a function of compulsorily blocking a collector current when an abnormal condition is sensed during flow of collector current, and wherein at a time of the collector current compulsory blocking, energy which has been charged in the ignition coil is caused to be emitted by repetitively generating the secondary voltage of the ignition coil which is under a plug discharge voltage.

2. The ignition apparatus according to claim 1, further comprising collector current compulsory blocking means for blocking the current in a step way while holding the power transistor in an active state, and for controlling gate voltage of the power transistor so that the secondary voltage repeatedly generated at the second side of the ignition coil is less than a plug discharge voltage.

3. The ignition apparatus according to claim 1, further comprising abnormality detecting means having an over-heat sensing circuit integrated with a power transistor board for emitting energy which has been charged in the ignition coil by repeatedly generating the secondary voltage of the ignition coil of which value is under the plug discharge voltage at the time of the collector current compulsory blocking, with occurrence of abnormal heat generation.

4. The ignition apparatus according to claim 2, wherein an amount of change of the primary current is selected to be under 0.5A and a period of time during which the current is held is selected to be above 100 $\mu$s, and wherein these are repeated to block the primary current in the step way.

5. The ignition apparatus according to claim 1, further comprising a latch circuit configured to prevent current flowing once the compulsory blocking occurs, until the ignition controlling signal again becomes low.

6. The ignition apparatus according to claim 2, wherein control is carried out such that a reference voltage of the circuit for controlling the current limiting is step-wise decreased so that the current limiting value corresponding thereto is step-wise decreased, thereby step-wise blocking the collector current.

7. The ignition apparatus according to claim 1, wherein an insulated gate type bipolar transistor (IGBT) is used as the power transistor, and the control circuit is a self-separation-type NMOS element.

8. A one-chip semiconductor for igniting an internal combustion engine, comprising a power transistor through which primary current of an ignition coil flows in response to an input signal, and means for step-wise decreasing collector current of said power transistor under an abnormal condition.

* * * * *